US006343748B1

(12) United States Patent
Pilesi et al.

(10) Patent No.: US 6,343,748 B1
(45) Date of Patent: Feb. 5, 2002

(54) CONCRETE RAILROAD TIE INSULATOR SPACER AND FASTENING SYSTEM

(75) Inventors: William D. Pilesi, Monroeville, PA (US); Richard A. Burke, Wheelersburg, OH (US)

(73) Assignee: KSA Limited Partnership, Pittsburgh, PA (US)

( * ) Notice: Subject to any disclaimer, the term of this patent is extended or adjusted under 35 U.S.C. 154(b) by 0 days.

(21) Appl. No.: 09/652,073

(22) Filed: Aug. 31, 2000

(51) Int. Cl.[7] ..... E01B 13/00
(52) U.S. Cl. ..... 238/310
(58) Field of Search ..... 238/310, 315, 238/321, 336, 338, 343, 351

(56) References Cited

U.S. PATENT DOCUMENTS

| | | | | |
|---|---|---|---|---|
| 3,576,293 A | | 4/1971 | Landis | 238/287 |
| 3,784,097 A | | 1/1974 | Landis | 238/310 |
| 3,831,842 A | * | 8/1974 | Tamura | 238/349 |
| 4,216,904 A | * | 8/1980 | Vivion | 238/25 |
| 4,967,954 A | * | 11/1990 | Von Lange | 238/310 |
| 6,027,034 A | | 2/2000 | Demmig et al. | 238/382 |
| 6,045,052 A | | 4/2000 | Besenschek | 238/382 |

OTHER PUBLICATIONS

Pandrol Rail Fastenings Ltd, "Concrete Sleeper Manufacture: Method Statement for the Assembly of Fastclip Sleepers," brochure, England 1998.

* cited by examiner

*Primary Examiner*—S. Joseph Morano
*Assistant Examiner*—Robert J. McCarry, Jr.
(74) *Attorney, Agent, or Firm*—Metz Lewis LLC; Thomas Lizzi; Barry I. Friedman

(57) ABSTRACT

A system for securing a rail to a concrete railroad tie employing an improved insulator spacer that improves the resistance of the insulator spacer to the crushing deterioration induced by laterally-directed compressive forces during service. The improved insulator spacer has at least one composite insert located in an area that is subjected to high compressive loads in service. The composite insert or inserts are sufficiently electrically insulating to operably electrically insulate the rail the improved insulator spacer is in contact with from the shoulder insert the improved insulator spacer is also in contact with.

154 Claims, 7 Drawing Sheets

TOP VIEW

FRONT VIEW

CONCRETE RAILROAD TIE INSULATOR SPACER AND FASTENING SYSTEM

FIELD OF THE INVENTION

The invention relates to fastening systems for securing rails to concrete railroad ties. In particular, the invention relates to fastening systems having improved insulator spacers. The invention also relates to the improved insulator spacers. The invention further relates to methods of securing a rail to a concrete railroad tie using such an improved insulator spacer and to methods of retrofitting a railroad system having a rail insulated from a shoulder insert mounted in a concrete railroad tie using such an improved insulator spacer.

BACKGROUND OF THE INVENTION

DESCRIPTION OF THE PRIOR ART

Concrete railroad ties have been used in modern railroads for many years. One of the various fastening systems that have been developed for securing rails to concrete railroad ties is shown in FIG. 1. At each rail seat area 2 where a rail 4 is to be fastened to concrete railroad tie 6, cast iron shoulder inserts 8, 10 are provided opposing each other on the field and gauge sides of the rail seat area 2, respectively. Each of the shoulder inserts 8, 10 is permanently mounted within the concrete railroad tie 6 at a position directly adjacent to the rail seat area 2. The rail 4 is mounted between the two shoulder inserts 8, 10 and upon an elastomeric tie pad 12 that spans the rail seat area 2 between the two shoulder inserts 8, 10. An insulator spacer 14 is placed adjacent to and abutting the base or toe 16 of rail 4 between rail 4 and each shoulder insert 8, 10. Each insulator spacer 14 has an inner surface that is adapted to conform to the shape of the vertical and sloping lateral faces of rail base 16. A retaining clip 18, that is attached to a shoulder insert 8, 10 by way of being inserted through a longitudinal receiving hole 20 in a shoulder insert 8, 10, presses upon the outer surface 22 of the corresponding insulator spacer 14 to rigidly secure rail 4 to concrete railroad tie 6.

In this system, the tie pad 12 and the insulator spacers 14 act to electrically insulate the rail 4 from its companion rail 4 and from the ground. Such electrical insulation is necessary to permit the rails 4 to be used to conduct electrical signals for monitoring and controlling the progress of the trains that run upon them.

However, electrical insulation is not the only important property that an insulator spacer 14 must possess. The passage of a train upon the rails 4 subjects the rails 4 to complex patterns of horizontal and vertical forces and vibrations. These forces are transmitted from the rails 4 to the fastening systems which retain the rails 4 to the railroad ties. These forces are particularly high on curved portions of the track where the laterally-directed compressive force on a shoulder insert 8, 10 may exceed 28,000 pounds. Because the insulator spacers 14 are sandwiched between the rails 4 and the shoulder inserts 8, 10, these forces subject the insulator spacers 14 to high compressive loads. To combat these loads, insulator spacers 14 have been made of a monolithic, durable insulating material having high compressive strength, such as 6-6 nylon. However, in service, the repeated exposure of the insulator spacers 14 to high compressive loads causes the insulator spacers 14 to deteriorate over time by way of crushing and abrasion. This deterioration occurs mainly in the portion of the insulator spacer 14 that is compressed between the shoulder insert 8, 10 and the vertical face of the rail base 16, a portion that is referred to as the post. As the deterioration progresses, the rail 4 becomes able to move, thus causing wear and fatigue on the fastening system components and the concrete railroad tie 6 and compromising the safety of train travel upon the rail 4. Thus, the deterioration makes it necessary to spend time and money to inspect the insulator spacers 14 for wear and to remove and replace worn insulator spacers 14.

It is to be understood that what is being referred to herein by the term insulator spacer is also referred to by those skilled in the art by the simple generic term insulator. However, the term insulator spacer is more descriptive as it brings to mind both the mechanical and electrical functions of the component.

SUMMARY OF THE INVENTION

The present invention overcomes the problems associated with the insulator spacer deterioration described above by providing an improved fastening system for securing a rail to a concrete railroad tie that employs an improved insulator spacer. The improved insulator spacer has at least one composite insert located in an area of the improved insulator spacer that is subjected to high compressive loads in service. The composite insert or inserts are located and sized so that together the composite inserts carry most of the laterally-directed compressive load that is exerted in service upon the improved insulator spacer by the rail and the shoulder insert. The composite insert or inserts have a compression fatigue lifetime that is substantially longer than that of the material of the improved insulator spacer body that contains the composite insert. The composite insert or inserts are sufficiently electrically insulating so as to operably electrically isolate the rail the improved insulator spacer is in contact with from the shoulder insert the improved insulator spacer is also in contact with.

Thus, described is a fastening system for securing a rail to a concrete railroad tie wherein the concrete railroad tie has a rail seat area on which the rail rests. The fastening system comprises a shoulder insert mounted in the concrete railroad tie adjacent to the rail seat area, an improved insulator spacer inserted between the shoulder insert and the rail, and a retaining clip attached to the shoulder insert. The improved insulator spacer has a post and also has a composite insert positioned in the post so that the shoulder insert and the rail each contact the composite insert.

The composite insert is designed to place wear resistant, durably tough material in contact with the adjacent surfaces of the rail and the shoulder insert thereby enhancing the mechanical lifetime of the improved insulator spacer of which it is a part. The composite insert also has high compressive strength, electrically insulating material sandwiched between its tough outer layers to provide electrical insulation between the rail and the shoulder insert.

An improved insulator spacer having at least one such composite insert is also described.

Also described is a method of securing a rail to a concrete railroad tie. This method comprises the step of inserting an improved insulator spacer between a rail and a shoulder insert which is mounted in a concrete railroad tie. The improved insulator spacer used in this method has a post having a composite insert positioned in the post so that the shoulder insert and the rail each contact the composite insert.

Also described is a method of retrofitting a railroad system that has a rail insulated by means of an existing insulator spacer from a shoulder insert which is mounted in a concrete railroad tie. This method comprises the steps of first removing the existing insulator spacer and then inserting between the rail and the shoulder insert an improved insulator spacer which has a post having a composite insert positioned therein so that the shoulder insert and the rail each contact the composite insert.

Other features and advantages inherent in the subject matter claimed and described will become apparent to those skilled in the art from the following detailed description of presently preferred embodiments thereof and to the appended drawings.

BRIEF DESCRIPTION OF THE DRAWINGS

The criticality of the features and merits of the present invention will be better understood by reference to the attached drawings wherein similar reference characters denote similar elements throughout the several figures. It is to be understood, however, that the drawings are designed for the purpose of illustration only and not as a definition of the limits of the present invention.

DESCRIPTION OF THE PREFERRED EMBODIMENTS

Figure 1:
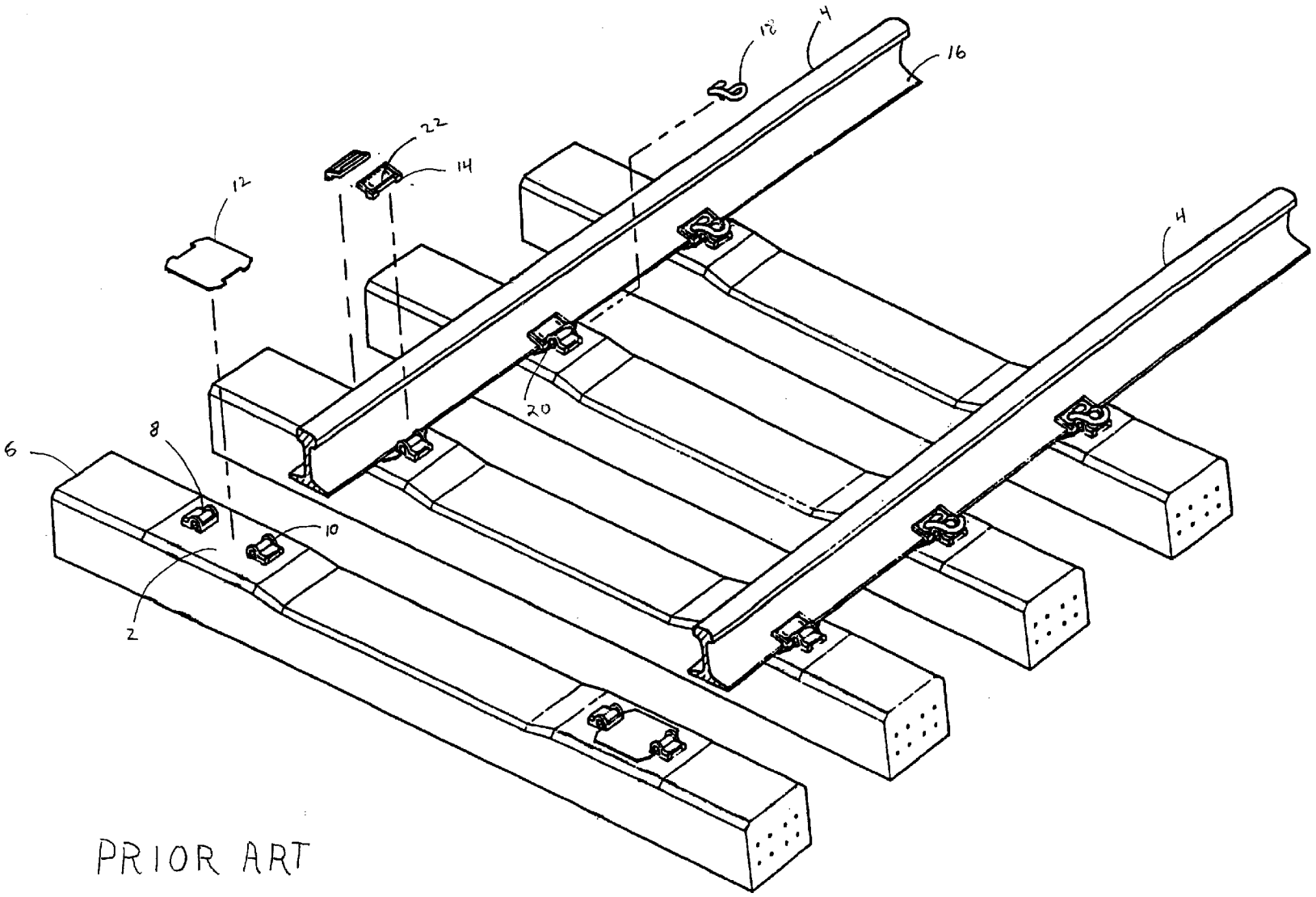
FIG. 1 PRIOR ART
FIG. 1 is a schematic showing an isometric view, partially exploded, of a prior art fastening system for securing rails to concrete railroad ties.
Figure 2A:
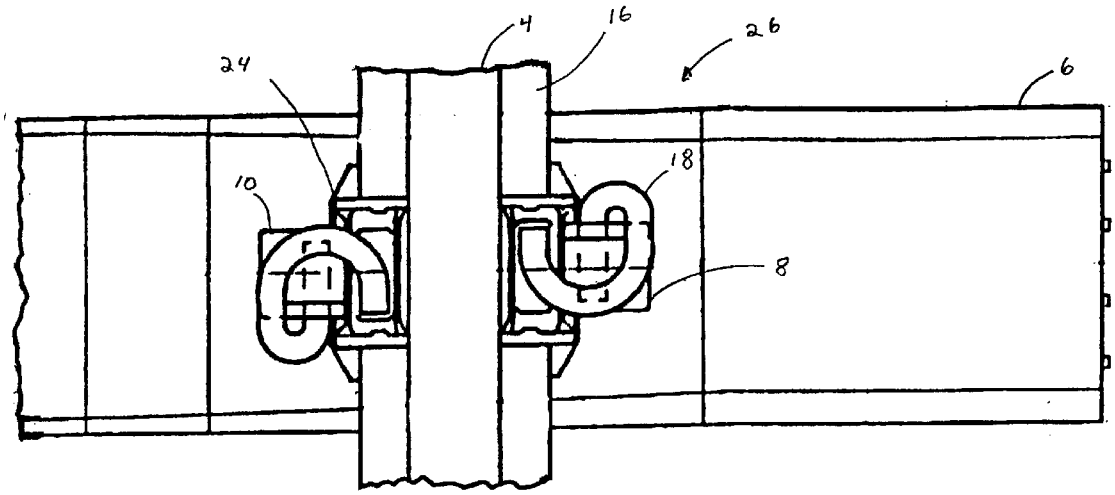
FIG. 2A is a top view, partially in cross-section, of a fastening system according to an embodiment of the present invention.
Figure 2B:
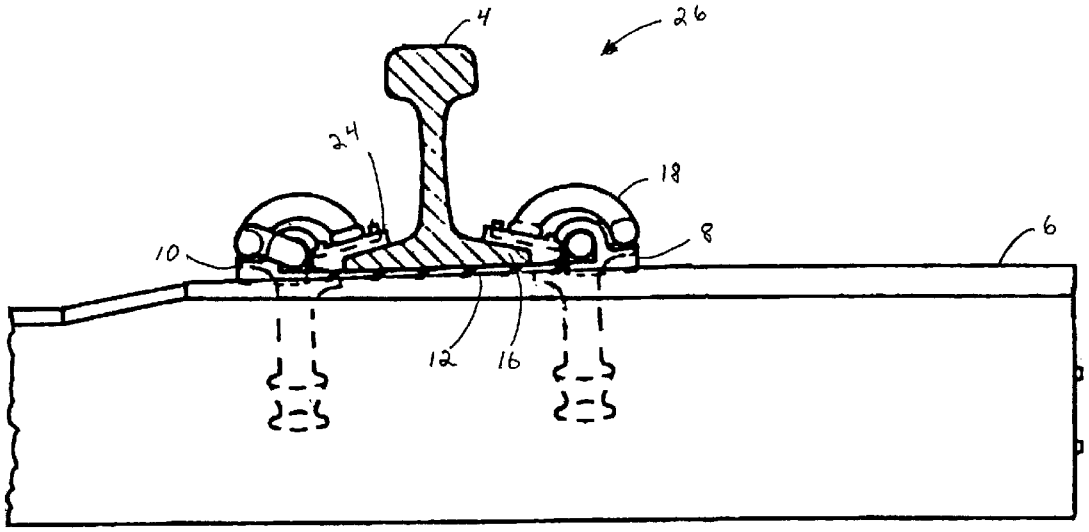
FIG. 2B is a side view of the fastening system illustrated in FIG. 2A.

FIGS. 2A and 2B illustrate an improved fastening system 26 according to the present invention for securing a rail 4 to a concrete railroad tie 6. The improved fastening system 26 shown in FIGS. 2A and 2B includes all of the same components as the prior art fastening system shown in FIG. 1 except that the prior art monolithic insulator spacer 14 has been replaced by improved insulator spacer 24 according to the present invention.

Referring to FIGS. 2A and 2B, in improved fastening system 26, rail 4 is seated upon tie pad 12 and a corresponding retaining clip 18 is attached to each of shoulder inserts 8, 10 and firmly presses a corresponding improved insulator spacer 24 against the base 16 of rail 4. These components cooperate to firmly secure rail 4 to concrete railroad tie 6.

Figure 3:
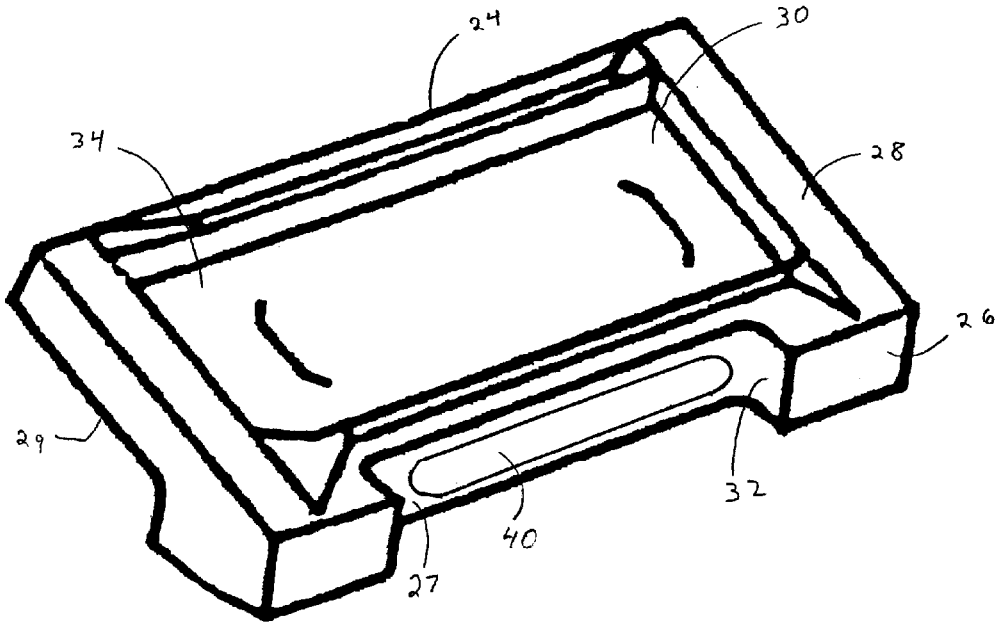
FIG. 3 is an isometric view of an insulator spacer according to one embodiment of the present invention.

A first embodiment of improved insulator spacer 24 is shown in FIG. 3. Referring to FIG. 3, improved insulator spacer 24 has a vertical member 26. Vertical member 26 includes post 27 which is the portion of improved insulator spacer 24 that, in service, stands between the shoulder insert 8, 10 and the vertical face of the rail base 16. Improved insulator spacer 24 also has an upwardly sloping member, toe 28, which has an inner surface 29 that is adapted to conform to the sloping lateral face of the rail base 16. Toe 28 also has an outer surface 30 which is pressed upon by a retaining clip 18 to clamp toe 28 against an underlying rail base 16.

Vertical member 26 and toe 28 may take on a various geometric configurations so long as improved insulator spacer 24 is able to perform its spacing and electrical insulating functions. For example, vertical member 26 and toe 28 may include pockets, such as shoulder insert receiving pocket 32 in vertical member 26 and retaining clip receiving pocket 34 in toe 28. These members may also have angular or tapered outlines or surfaces, for example as illustrated in FIGS. 4A and 4B.

Figure 4A:
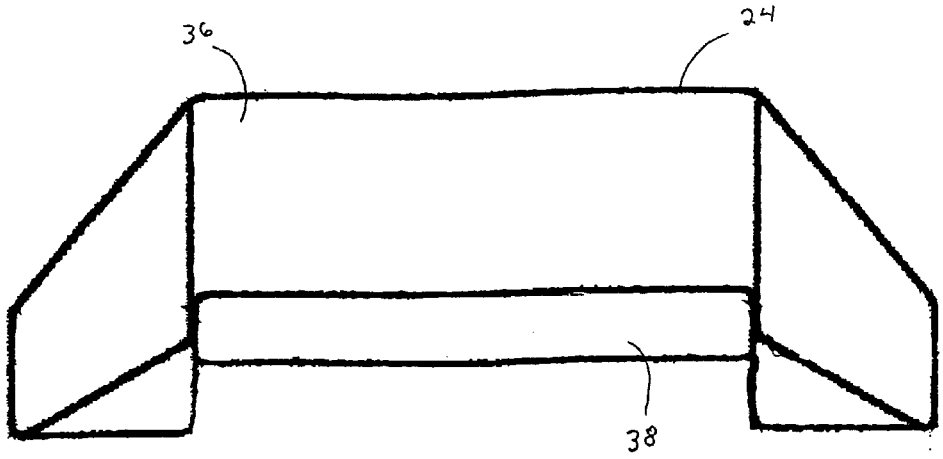
FIG. 4A is a top view of an insulator spacer according to an alternate embodiment of the present invention having first and second separable sections.
Figure 4B:
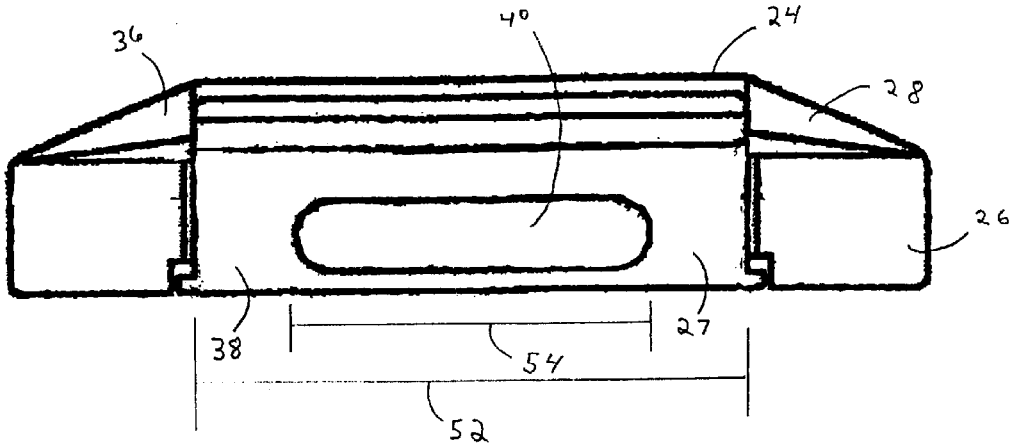
FIG. 4B is a front elevation view of the insulator spacer shown in FIG. 4A showing the side that faces the shoulder insert.

As shown in FIGS. 4A and 4B, vertical member 26 and toe 28 may be provided as separable sections which are mated together during service. Improved insulator spacer 24 may also be comprised of multiple separable sections in which one or more of the separable sections contain portions of one or both of the vertical member 26 and the toe 28 of the improved insulator spacer 24. For example, FIGS. 4A and 4B illustrate an alternative embodiment in which improved insulator spacer 24 comprises first separable section 36, which includes toe 28 and part of vertical member 26, and second separable section 38, which chiefly consists of the post 27 of vertical member 26.

Furthermore, embodiments of improved insulator spacer 24 may also be configured without toe 28. One such embodiment is shown in FIG. 7.

The body of improved insulator spacer 24 may be made of any durable insulating material known to one skilled in the art having a suitably high compression strength for the application. Such materials include materials which are commonly used for insulator spacers, although materials having lower compression strength may also be used because most of the laterally-directed compressive forces on the improved insulator spacer 24 are carried by the composite insert or inserts 40. Preferably, the body of improved insulator spacer 24 comprises 6-6 nylon.

Figure 7:
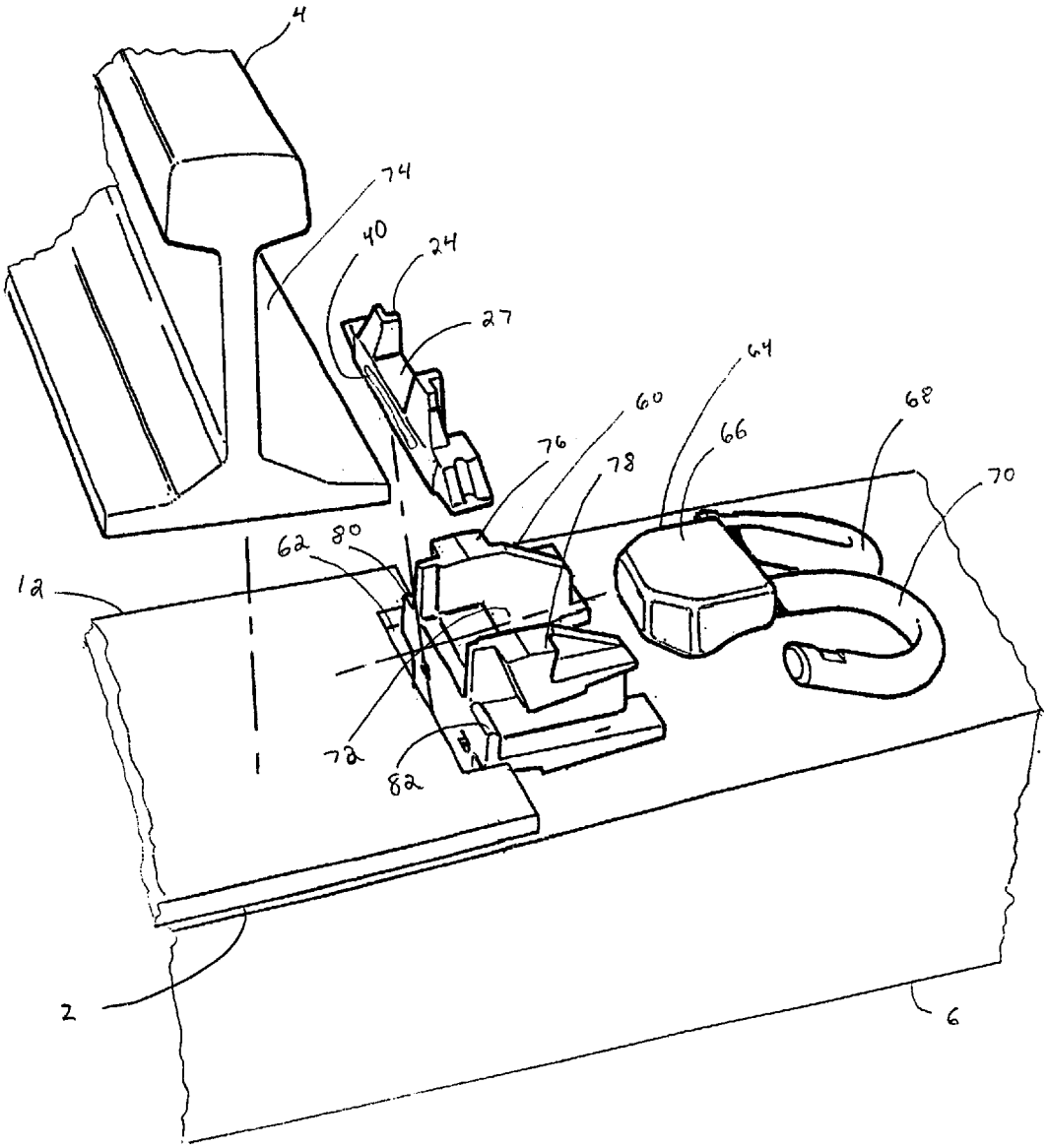
FIG. 7 is a schematic showing an isometric view, partially exploded, of a fastening system for securing rails to concrete railroad ties according to a further alternative embodiment of the present invention.

Referring to FIGS. 3, 4B, and 7, improved insulator spacer 24 also comprises composite insert 40. Composite insert 40 is located in post 27, an area that is subjected to high laterally-directed compressive loads in service. Composite insert 40 has a compression fatigue lifetime that is substantially longer than that of the body material of improved insulator spacer 24 that contains composite insert 40.

Composite insert 40 is designed to place a wear resistant, durably tough material in contact with the adjacent surfaces of the rail 4 and the shoulder insert 8, 10 thereby enhancing the mechanical lifetime of the improved insulator spacer 24 of which it is a part. A high compressive strength, electrically insulating material is sandwiched between the outer layers of composite insert 40 to provide electrical insulation between the rail 4 and the shoulder insert 8, 10.

Figure 5:
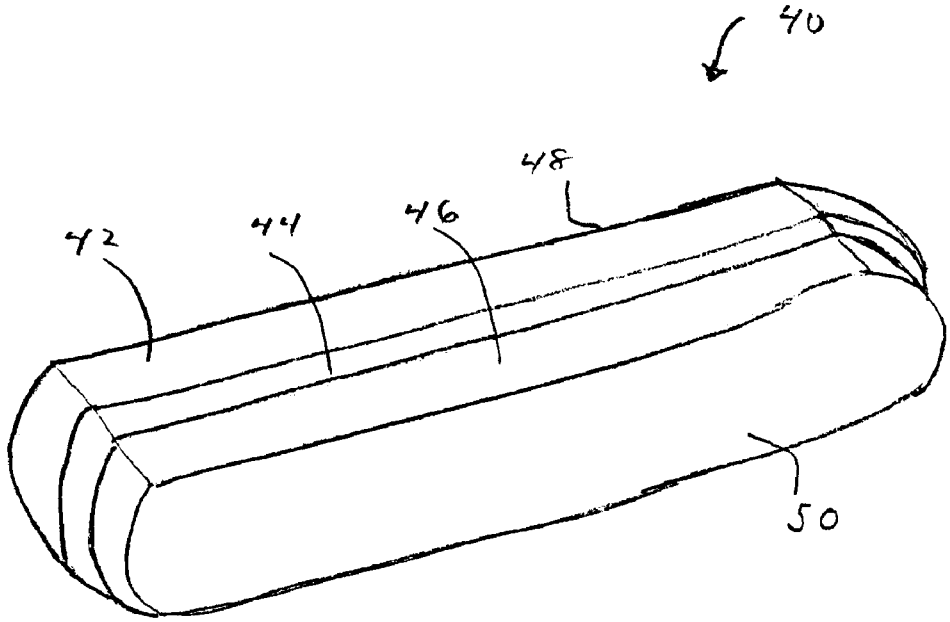
FIG. 5 is an isometric view of an embodiment of a composite insert according to the present invention.

FIG. 5 shows an embodiment of a composite insert 40 having three layers. In this embodiment, composite insert 40 comprises first outer layer 42, insulating layer 44, and second outer layer 46. In service, first outer face 48 of first outer layer 42 and second outer face 50 of second outer layer 46 are in contact with, respectively, the vertical face of the rail base 16 and the rail-facing surface of the shoulder insert 8, 10 so that composite insert 40 carries most of the laterally-directed compressive load that is exerted in service upon improved insulator spacer 24 by the rail 4 and the shoulder insert 8, 10.

First and second outer layers 42, 46 are made of a wear resistant, durably tough material. First and second outer layers 42, 46 are preferably made of steel having a tensile strength of greater than about 55,000 pounds per square inch, more preferably made of a steel having a yield strength of between about 20,000 and about 30,000 pounds per square inch, and most preferably made of a steel having a yield strength of between about 24,000 and about 30,000 pounds per square inch. Examples of suitable steels are ASTM A283-58 Grade A steel and ASTM A285-57T Grade A steel. Other steels or other materials may be used for the first and second outer layers 42, 46 so long as the material used is not brittle, has wear comparability with the surface of the shoulder insert 8, 10 or the rail 4 it contacts in service, and provides a compression fatigue lifetime to the composite insert 40 that is substantially longer under service conditions than that of 6-6 nylon. First and second layers 42, 46 may be made of the same material or of different materials.

Insulating layer 44 is comprised of an electrically insulating material, for example without limitation, a high compression strength plastic or ceramic. Preferably, the electrically insulating material is a mica-filled phenolic plastic such as a Formica® material, which is available from the Formica Corporation, 10155 Reading Road, Cincinnati, Ohio 45241. Other examples of suitable plastics are filled nylons such as a Nylatron® material, which is available from DSM Engineering Plastic Products, 2120 Fairmont Avenue, Reading, Pa., U.S., 19612-4235, and fiberglass-reinforced polyphenylene sulfide compounds such as a Ryton® material, which is available from Chevron Phillips Chemical Co., Specialty Chemicals and Specialty Plastics, P.O. Box 7777, Bartlesville, Okla., U.S. 74005-7777. Suitable ceramics include without limitation aluminum oxide and silicon nitride.

The thickness of composite insert 40 is substantially the same as that of the adjacent body material of improved insulator spacer 24 that contains composite insert 40. Although the composite insert 40 is shown in FIG. 5 as having three layers, it may have any number of layers so long as the layers in contact with the surfaces of the rail and the shoulder insert are made of wear resistant, durably tough material and so long as there is one or more insulating layers that cause the composite insert 40 to be an electrical insulator capable of electrically isolating the rail 4 from the shoulder insert 8, 10. The thickness of each layer will depend on the number of layers used, the particular materials used for each layer, and the overall thickness of the composite insert 40. A layer may have a thickness that is the same or different from that of another layer or layers. Preferably, to optimize the mechanical properties of the composite insert 40, the thickness of the insulating layer or layers are minimized and the thicknesses of the durably tough material layers are maximized. For example, for a three-layer composite insert 40 such as that shown in FIG. 5 having steel as the outer layers 42, 46 and a mica-filled phenolic plastic as the insulating layer 44, it is preferred that the insulating layer 44 have a thickness of about one-half of that of each of the outer layers 42, 46. Thus, for a composite insert 40 having an overall thickness of about 5/16 inches, the thickness of each of the outer layers 42, 46 is preferably about 1/8 inch and the thickness of the insulator layer 44 is about 1/16 inch.

Although interlayer bonding is not necessary for the use of the present invention, the layers of composite insert 40 are preferably bonded together to facilitate the construction and use of improved insulator spacer 24. The layers may be bonded together by an epoxy or urethane or by other suitable bonding materials known to those skilled in the art. The bonding material used preferably has a compression strength that is at least as great as that of the lowest compression strength layer of the composite insert. Examples of suitable bonding materials include epoxies such as Concresive® epoxy, which available from ChemRex, Inc., 889 Valley Park Drive, Shakopee, Minn., U.S., 55379, and Polybac1605 epoxy, which is available from Polygem, Inc., 1105 Carolina Drive, West Chicago, Ill., U.S., 60185. Although there is no restriction on the thickness of the interlayer bonding material, preferably, the bonding material thicknesses are on the order of 0.005 inches.

Figure 6:
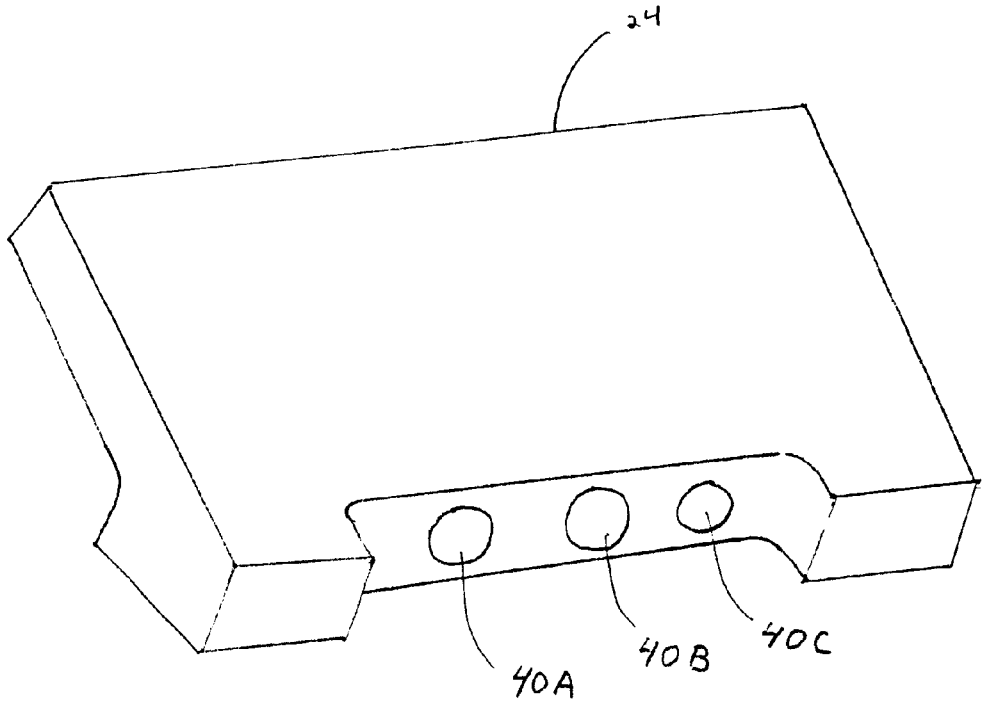
FIG. 6 is an isometric view of an insulator spacer according to a further alternative embodiment of the present invention.

The improved insulator spacer 24 may have one or more composite inserts of any size or shape. It is preferred, however, that the corners or ends of the composite insert or inserts 40 be rounded because sharp corners may act as stress raisers in the adjacent body material of the improved insulator spacer 24 and cause cracking in that body material. For example, FIG. 3 shows one embodiment of an improved insulator spacer 24 having a single composite insert 40 which has an oblong cross-section and FIG. 6 shows an alternate embodiment of improved insulator spacer 24 having three cylindrical composite inserts 40, that is, first, second and third composite inserts 40A, 40B, 40C.

Although composite insert or inserts 40 of the improved insulator spacer 24 may be located anywhere in the post 27 of the improved insulator spacer 24, it is preferred that they be located so as to avoid loading the corners of the shoulder inserts 8, 10. Therefore, where a single composite insert 40 is used, it is preferred that it be centered along the length of the post 27 and its length be no more than about two-thirds the length of the post 27. For example, referring to FIG. 4B, if post length 52 is about 3 inches, it is preferred that composite insert length 54 be no greater than about 2 inches.

One or more composite inserts 40 may be directly incorporated into the body of the improved insulator spacer 24 during the molding of the improved insulator spacer 24 or a separable portion thereof. Alternatively, the body of the improved insulator spacer 24 or a separable portion thereof may be formed with a hole or holes for receiving one or more composite inserts 40. Preferably, the composite insert 40 is shaped so that the adjacent body material of the improved insulator spacer 24 locks into the composite insert 40 in a tongue and groove fashion to enhance the attachment of the composite insert 40 to the improved insulator spacer 24.

The improved insulator spacer 24 may be used in a method of securing a rail to a concrete railroad tie. This method comprises the step of inserting an improved insulator spacer 24 between a rail 4 and a shoulder insert 8, 10 which is mounted in a concrete railroad tie 6. The insertion is done in a manner that places the composite insert 40 that is located in the post 27 of improved insulator spacer 24 in contact with rail 4 and shoulder insert 8, 10. After the improved insulator spacer 24 is so inserted, a retaining clip 18 may be attached to the shoulder insert 8, 10 to secure the rail 4 to the concrete railroad tie 6.

Similarly, the improved insulator spacer 24 may also be used in a method of retrofitting a railroad system utilizing concrete railroad ties 6 that has a rail 4 insulated by means of an existing insulator spacer from a shoulder insert 8, 10. The existing insulator spacer may be any type of insulator spacer including an improved insulator spacer 24. This method comprises the steps of first removing the existing insulator spacer and then inserting between the rail 4 and the shoulder insert 8, 10 an improved insulator spacer 24. The insertion is done in a manner that places the composite insert 40 that is located in the post 27 of improved insulator spacer 24 in contact with rail 4 and shoulder insert 8, 10. After the improved insulator spacer 24 is so inserted, a retaining clip 18 may be attached to the shoulder insert 8, 10 to secure the rail 4 to the concrete railroad tie 6.

It is to be understood that the improved insulator spacers, fastening systems, methods of securing a rail to a concrete railroad tie, and methods of retrofitting encompassed by the present invention are not limited to the particular configurations of the components described in the embodiments discussed above. Rather, the improved insulator spacers, fastening systems, methods of securing a rail to a concrete railroad tie, and methods of the retrofitting encompassed by the present invention are adaptable for use with all component configurations known to those skilled in the art. For example, FIG. 7 shows a fastening system according to another embodiment of the present invention which employs component configurations which differ in some respects from those previously described herein. In particular, in the shown embodiment, the shoulder insert, the clip, and the improved insulator spacer are configured so that the clip is inserted perpendicular to the rail rather than parallel to the rail as was the case in the previously described embodiments.

Referring to FIG. 7, rail 4 seats upon tie pad 12 which is situated in rail seat area 2 adjacent to shoulder insert 60. Improved insulator spacer 24 inserts between rail 4 and shoulder insert 60 and extends downwardly into gap 62 between tie pad 12 and shoulder insert 60 to rest upon concrete railroad tie 6. When so positioned, composite insert 40, which is located in post 27 of improved insulator spacer 24, contacts both rail 4 and shoulder insert 60. Insulated clip 64, which comprises insulator portion 66 and first and second hooks 68, 70, is inserted into shoulder insert 60 so that insulator portion 66 passes through shoulder insert throat 72 to contact sloping lateral face 74 of rail 4 and so that first and second hooks 68, 70, respectively, become locked between first and second arms 76, 78 and first and second ears 80, 82. With insulated clip 64 so attached to shoulder insert 60, rail 4 becomes secured to concrete railroad tie 6. A similar arrangement of components may be used on the side of rail 4 which is opposite shoulder insert 60.

While only a few presently preferred embodiments of the invention are described, it is to be distinctly understood that the invention is not limited thereto but may be otherwise embodied and practiced within the scope of the following claims.

What is claimed is:

1. A system for securing a rail to a concrete railroad tie, said concrete railroad tie having a rail seat area on which said rail rests, the system comprising:

a) a shoulder insert mounted in said concrete railroad tie adjacent to said rail seat area;

b) an insulator spacer inserted between said shoulder insert and said rail, said insulator spacer having a post and having a composite insert positioned therein, wherein said shoulder insert and said rail each contact said composite insert; and c) a retaining clip attached to said shoulder insert;

whereby said rail is secured to said concrete railroad tie.

2. The system according to claim 1, wherein said shoulder insert is mounted adjacent to a field side of said rail seat area.

3. The system according to claim 1, wherein said composite insert comprises a plurality of layers, wherein said plurality of layers includes an electrically insulating layer located between a first outer layer and a second outer layer.

4. The system according to claim 3, wherein at least one of said first and second outer layers comprises steel.

5. The system according to claim 4, wherein at least one of said first and second outer layers comprises steel having a tensile strength of at least about 55,000 pounds per square inch.

6. The system according to claim 4, wherein at least one of said first and second outer layers comprises steel having a yield strength of between about 20,000 and about 30,000 pounds per square inch.

7. The system according to claim 6, wherein at least one of said first and second outer layers comprises steel having a yield strength of between about 24,000 and about 30,000 pounds per square inch.

8. The system according to claim 4, wherein at least one of said first and second outer layers comprises steel selected from the group consisting of ASTM A283-58 Grade A steel and ASTM A285-57T Grade A steel.

9. The system according to claim 3, wherein said electrically insulating layer comprises a mica-filled phenolic plastic.

10. The system according to claim 3, wherein said electrically insulating layer comprises a plastic selected from the group consisting of a filled nylon and a fiberglass-reinforced polyphenylene sulfide compound.

11. The system according to claim 3, wherein said electrically insulating layer comprises a ceramic.

12. The system according to claim 11, wherein said ceramic comprises aluminum oxide.

13. The system according to claim 11, wherein said ceramic comprises silicon nitride.

14. The system according to claim 3, wherein a thickness of said electrically insulating layer is less than a thickness of at least one of said first and second outer layers.

15. The system according to claim 14, wherein the thickness of said electrically insulating layer is about one half of the thickness of at least one of said first and second outer layers.

16. The system according to claim 15, wherein the thickness of said electrically insulating layer is about 1/16 inch and the thickness of at least one of said first and second outer layers is about 1/8 inch.

17. The system according to claim 3, wherein at least two layers of said plurality of layers are bonded together by a bonding material.

18. The system according to claim 17, wherein said bonding material comprises an epoxy.

19. The system according to claim 17, wherein said bonding material comprises a urethane.

20. The system according to claim 1, wherein said composite insert includes a rounded end.

21. The system according to claim 20, wherein said composite insert has a cylindrical shape.

22. The system according to claim 20, wherein said one composite insert has an oblong cross-section.

23. The system according to claim 1, wherein said composite insert is centered along a length of said post.

24. The system according to claim 23, wherein said composite insert has a length which is no greater than about two-thirds of said length of said post.

25. The system according to claim 1, wherein said insulator spacer includes a toe, said toe having a surface adapted to conform to a sloping lateral face of a base of said rail.

26. The system according to claim 25, wherein said toe includes a surface adapted to be contacted by said retaining clip.

27. The system according to claim 25, wherein said insulator spacer comprises a plurality of separable sections.

28. The system according to claim 1, wherein said insulator spacer comprises 6-6 nylon.

29. The system according to claim 1, wherein said insulator spacer includes a pocket for receiving said shoulder insert.

30. The system according to claim 1, wherein said insulator spacer includes a pocket for receiving said retaining clip.

31. A system for securing a rail to a concrete railroad tie, said concrete railroad tie having a rail seat area on which said rail rests, the system comprising:

a) a first shoulder insert mounted in said concrete railroad tie adjacent to a gauge side of said rail seat area;

b) a second shoulder insert mounted in said concrete railroad tie adjacent to a field side of said rail seat area;

c) a first insulator spacer inserted between said rail and said first shoulder insert, said first insulator spacer having a post having a composite insert positioned therein, wherein said rail and said first shoulder insert each contact said composite insert of said first insulator spacer;

d) a second insulator spacer inserted between said rail and said second shoulder insert, said second insulator spacer having a post having a composite insert positioned therein, wherein said rail and said second shoulder insert each contact said composite insert of said second insulator spacer;

e) a first retaining clip attached to said first shoulder insert; and f) a second retaining clip attached to said second shoulder insert;

whereby said rail is secured to said concrete railroad tie.

32. The system according to claim 31, wherein at least one of said first insulator spacer composite insert and said second insulator spacer composite insert comprises a plurality of layers, wherein said plurality of layers includes an electrically insulating layer located between a first outer layer and a second outer layer.

33. The system according to claim 32, wherein at least one of said first and second outer layers comprises steel.

34. The system according to claim 33, wherein at least one of said first and second outer layers comprises steel having a tensile strength of at least about 55,000 pounds per square inch.

35. The system according to claim 33, wherein at least one of said first and second outer layers comprises steel having a yield strength of between about 20,000 and about 30,000 pounds per square inch.

36. The system according to claim 34, wherein at least one of said first and second outer layers comprises steel having a yield strength of between about 24,000 and about 30,000 pounds per square inch.

37. The system according to claim 33, wherein at least one of said first and second outer layers comprises steel selected from the group consisting of ASTM A283-58 Grade A steel and ASTM A285-57T Grade A steel.

38. The system according to claim 32, wherein said electrically insulating layer comprises a mica-filled phenolic plastic.

39. The system according to claim 32, wherein said electrically insulating layer comprises a plastic selected from the group consisting of a filled nylon and a fiberglass-reinforced polyphenylene sulfide compound.

40. The system according to claim 32, wherein said electrically insulating layer comprises a ceramic.

41. The system according to claim 40, wherein said ceramic comprises aluminum oxide.

42. The system according to claim 40, wherein said ceramic comprises silicon nitride.

43. The system according to claim 32, wherein a thickness of said electrically insulating layer is less than a thickness of at least one of said first and second outer layers.

44. The system according to claim 43, wherein the thickness of said electrically insulating layer is about one half of the thickness of at least one of said first and second outer layers.

45. The system according to claim 44, wherein the thickness of said electrically insulating layer is about 1/16 inch and the thickness of at least one of said first and second outer layers is about 1/8 inch.

46. The system according to claim 32, wherein at least two layers of said plurality of layers are bonded together by a bonding material.

47. The system according to claim 46, wherein said bonding material comprises an epoxy.

48. The system according to claim 46, wherein said bonding material comprises a urethane.

49. The system according to claim 31, wherein at least one of said first insulator spacer composite insert and second insulator spacer composite insert includes a rounded end.

50. The system according to claim 49, wherein said composite insert having a rounded end has a cylindrical shape.

51. The system according to claim 49, wherein said composite insert having a rounded end has an oblong cross-section.

52. The system according to claim 31, wherein said composite insert of said first insulator spacer is centered along a length of said post of said first insulator spacer.

53. The system according to claim 52, wherein said composite insert of said first insulator spacer has a length which is no greater than about two-thirds of said length of said post of said first insulator spacer.

54. The system according to claim 31, wherein said composite insert of said second insulator spacer is centered along a length of said post of said second insulator spacer.

55. The system according to claim 54, wherein said composite insert of said second insulator spacer has a length which is no greater than about two-thirds of said length of said post of said second insulator spacer.

56. The system according to claim 31, wherein at least one of said first and second insulator spacers has a toe, said toe having a surface adapted to conform to a sloping lateral face of a base of said rail.

57. The system according to claim 56, wherein said toe also has a surface adapted to be contacted by one of said first retaining clip or second retaining clip.

58. The system according to claim 56, wherein said insulator spacer having a toe comprises a plurality of separable sections.

59. The system according to claim 31, wherein at least one of said first and second insulator spacers comprises 6-6 nylon.

60. The system according to claim 31, wherein said first insulator spacer includes a pocket for receiving said first shoulder insert.

61. The system according to claim 31, wherein said second insulator spacer includes a pocket for receiving said second shoulder insert.

62. The system according to claim 31, wherein said first insulator spacer includes a pocket for receiving said first retaining clip.

63. The system according to claim 31, wherein said second insulator spacer includes a pocket for receiving said second retaining clip.

64. An insulator spacer for insertion between a rail and a shoulder insert mounted in a concrete railroad tie, the insulator spacer comprising:

a) a post; and b) a composite insert located in said post, said composite insert positioned to be in contact with said rail and said shoulder insert when said insulator spacer is inserted between said rail and said shoulder insert.

65. The insulator spacer according to claim 64, wherein said composite insert comprises a plurality of layers, said plurality of layers including an electrically insulating layer located between a first outer layer and a second outer layer.

66. The insulator spacer according to claim 65, wherein at least one of said first and second outer layers comprises steel.

67. The insulator spacer according to claim 66, wherein at least one of said first and second outer layers comprises steel having a tensile strength of at least about 55,000 pounds per square inch.

68. The insulator spacer according to claim 66, wherein at least one of said first and second outer layers comprises steel having a yield strength of between about 20,000 and about 30,000 pounds per square inch.

69. The insulator spacer according to claim 68, wherein at least one of said first and second outer layers comprises steel having a yield strength of between about 24,000 and about 30,000 pounds per square inch.

70. The insulator spacer according to claim 66, wherein at least one of said first and second outer layers comprises steel selected from the group consisting of ASTM A283-58 Grade A steel and ASTM A285-57T Grade A steel.

71. The insulator spacer according to claim 65, wherein said electrically insulating layer comprises a mica-filled phenolic plastic.

72. The insulator spacer according to claim 65, wherein said electrically insulating layer comprises a plastic selected from the group consisting of a filled nylon and a fiberglass-reinforced polyphenylene sulfide compound.

73. The insulator spacer according to claim 65, wherein said electrically insulating layer comprises a ceramic.

74. The insulator spacer according to claim 73, wherein said ceramic comprises aluminum oxide.

75. The insulator spacer according to claim 73, wherein said ceramic comprises silicon nitride.

76. The insulator spacer according to claim 65, wherein a thickness of said electrically insulating layer is less than a thickness of at least one of said first and second outer layers.

77. The insulator spacer according to claim 76, wherein the thickness of said electrically insulating layer is about one half of the thickness of at least one of said first and second outer layers.

78. The insulator spacer according to claim 77, wherein the thickness of said electrically insulating layer is about 1/16 inch and the thickness of at least one of said first and second outer layers is about 1/8 inch.

79. The insulator spacer according to claim 65, wherein at least two layers of said plurality of layers are bonded together by a bonding material.

80. The insulator spacer according to claim 79, wherein said bonding material comprises an epoxy.

81. The insulator spacer according to claim 79, wherein said bonding material comprises a urethane.

82. The insulator spacer according to claim 64, wherein said composite insert includes a rounded end.

83. The insulator spacer according to claim 82, wherein said composite insert has a cylindrical shape.

84. The insulator spacer according to claim 82, wherein said composite insert has an oblong cross-section.

85. The insulator spacer according to claim 64, wherein said composite insert is centered along a length of said post.

86. The insulator spacer according to claim 85, wherein said composite insert has a length which is no greater than about two-thirds of said length of said post.

87. The insulator spacer according to claim 64, further comprising a toe, said toe having a surface adapted to conform to a sloping lateral face of a base of said rail.

88. The insulator spacer according to claim 87, wherein said toe includes a surface adapted to be contacted by a retaining clip.

89. The insulator spacer according to claim 87, further comprising a plurality of separable sections.

90. The insulator spacer according to claim 64, further comprising 6-6 nylon.

91. The insulator spacer according to claim 64, wherein said insulator spacer includes a pocket for receiving said shoulder insert.

92. The insulator spacer according to claim 64, wherein said insulator spacer includes a pocket for receiving a retaining clip.

93. A method of securing a rail to a concrete railroad tie, said concrete railroad tie having a rail seat area upon which said rail rests, the method comprising the step of inserting an insulator spacer between a shoulder insert and said rail, said shoulder insert being mounted in said concrete railroad tie adjacent said rail seat area, said insulator spacer having a post and having a composite insert positioned therein, wherein said shoulder insert and said rail each contact said composite insert.

94. The method according to claim 93, further comprising the step of attaching a retaining clip to said shoulder insert.

95. The method according to claim 93, wherein said shoulder insert is mounted adjacent to a field side of said rail seat area.

96. The method according to claim 93, wherein said composite insert comprises a plurality of layers, wherein said plurality of layers includes an electrically insulating layer located between a first outer layer and a second outer layer.

97. The method according to claim 96, wherein at least one of said first and second outer layers comprises steel.

98. The method according to claim 97, wherein at least one of said first and second outer layers comprises steel having a tensile strength of at least about 55,000 pounds per square inch.

99. The method according to claim 97, wherein at least one of said first and second outer layers comprises steel having a yield strength of between about 20,000 and about 30,000 pounds per square inch.

100. The method according to claim 99, wherein at least one of said first and second outer layers comprises steel having a yield strength of between about 24,000 and about 30,000 pounds per square inch.

101. The method according to claim 97, wherein at least one of said first and second outer layers comprises steel selected from the group consisting of ASTM A283-58 Grade A steel and ASTM A285-57T Grade A steel.

102. The method according to claim 96, wherein said electrically insulating layer comprises a mica-filled phenolic plastic.

103. The method according to claim 96, wherein said electrically insulating layer comprises a plastic selected from the group consisting of a filled nylon and a fiberglass-reinforced polyphenylene sulfide compound.

104. The method according to claim 96, wherein said electrically insulating layer comprises a ceramic.

105. The method according to claim 104, wherein said ceramic comprises aluminum oxide.

106. The method according to claim 104, wherein said ceramic comprises silicon nitride.

107. The method according to claim 96, wherein a thickness of said electrically insulating layer is less than a thickness of at least one of said first and second outer layers.

108. The method according to claim 107, wherein the thickness of said electrically insulating layer is about one half of the thickness of at least one of said first and second outer layers.

109. The method according to claim 108, wherein the thickness of said electrically insulating layer is about 1/16 inch and the thickness of at least one of said first and second outer layers is about 1/8 inch.

110. The method according to claim 96, wherein at least two layers of said plurality of layers are bonded together by a bonding material.

111. The method according to claim 110, wherein said bonding material comprises an epoxy.

112. The method according to claim 110, wherein said bonding material comprises a urethane.

113. The method according to claim 93, wherein said composite insert includes a rounded end.

114. The method according to claim 113, wherein said composite insert has a cylindrical shape.

115. The method according to claim 113, wherein said one composite insert has an oblong cross-section.

116. The method according to claim 93, wherein said composite insert is centered along a length of said post.

117. The method according to claim 116, wherein said composite insert has a length which is no greater than about two-thirds of said length of said post.

118. The method according to claim 94, wherein said insulator spacer includes a toe, said toe having a surface adapted to conform to a sloping lateral face of a base of said rail.

119. The method according to claim 118, wherein said toe includes a surface adapted to be contacted by said retaining clip.

120. The method according to claim 118, wherein said insulator spacer comprises a plurality of separable sections.

121. The method according to claim 93, wherein said insulator spacer comprises 6-6 nylon.

122. The method according to claim 93, wherein said insulator spacer includes a pocket for receiving said shoulder insert.

123. The method according to claim 94, wherein said insulator spacer includes a pocket for receiving said retaining clip.

124. A method of retrofitting a railroad system having a rail insulated from a shoulder insert mounted in a concrete railroad tie by a first insulator spacer, the method comprising the steps of:

a) removing said first insulator spacer; and b) inserting a second insulator spacer between said shoulder insert and said rail, said second insulator spacer having a post and having a composite insert located in said post;

wherein said shoulder insert and said rail each contact said composite insert.

125. The method according to claim 124, further comprising the step of attaching a retaining clip to said shoulder insert.

126. The method according to claim 124, wherein said shoulder insert is mounted adjacent to a field side of said rail seat area.

127. The method according to claim 124, wherein said composite insert comprises a plurality of layers, wherein said plurality of layers includes an electrically insulating layer located between a first outer layer and a second outer layer.

128. The method according to claim 127, wherein at least one of said first and second outer layers comprises steel.

129. The method according to claim 128, wherein at least one of said first and second outer layers comprises steel having a tensile strength of at least about 55,000 pounds per square inch.

130. The method according to claim 128, wherein at least one of said first and second outer layers comprises steel having a yield strength of between about 20,000 and about 30,000 pounds per square inch.

131. The method according to claim 130, wherein at least one of said first and second outer layers comprises steel having a yield strength of between about 24,000 and about 30,000 pounds per square inch.

132. The method according to claim 128, wherein at least one of said first and second outer layers comprises steel selected from the group consisting of ASTM A283-58 Grade A steel and ASTM A285-57T Grade A steel.

133. The method according to claim 127, wherein said electrically insulating layer comprises a mica-filled phenolic plastic.

134. The method according to claim 127, wherein said electrically insulating layer comprises a plastic selected from the group consisting of a filled nylon and a fiberglass-reinforced polyphenylene sulfide compound.

135. The method according to claim 127, wherein said electrically insulating layer comprises a ceramic.

136. The method according to claim 135, wherein said ceramic comprises aluminum oxide.

137. The method according to claim 135, wherein said ceramic comprises silicon nitride.

138. The method according to claim 127, wherein a thickness of said electrically insulating layer is less than a thickness of at least one of said first and second outer layers.

139. The method according to claim 138, wherein the thickness of said electrically insulating layer is about one half of the thickness of at least one of said first and second outer layers.

140. The method according to claim 139, wherein the thickness of said electrically insulating layer is about 1/16 inch and the thickness of at least one of said first and second outer layers is about 1/8 inch.

141. The method according to claim 127, wherein at least two layers of said plurality of layers are bonded together by a bonding material.

142. The method according to claim 141, wherein said bonding material comprises an epoxy.

143. The method according to claim 141, wherein said bonding material comprises a urethane.

144. The method according to claim 124, wherein said composite insert includes a rounded end.

145. The method according to claim 144, wherein said composite insert has a cylindrical shape.

146. The method according to claim 144, wherein said one composite insert has an oblong cross-section.

147. The method according to claim 124, wherein said composite insert is centered along a length of said post.

148. The method according to claim 147, wherein said composite insert has a length which is no greater than about two-thirds of said length of said post.

149. The method according to claim 125, wherein said insulator spacer includes a toe, said toe having a surface adapted to conform to a sloping lateral face of a base of said rail.

150. The method according to claim 149, wherein said toe includes a surface adapted to be contacted by said retaining clip.

151. The method according to claim 149, wherein said insulator spacer comprises a plurality of separable sections.

152. The method according to claim 124, wherein said insulator spacer comprises 6-6 nylon.

153. The method according to claim 124, wherein said insulator spacer includes a pocket for receiving said shoulder insert.

154. The system according to claim 125, wherein said insulator spacer includes a pocket for receiving said retaining clip.

* * * * *